US006180900B1

(12) United States Patent
Horiuchi

(10) Patent No.: US 6,180,900 B1
(45) Date of Patent: Jan. 30, 2001

(54) CONTACT KEY SWITCH AND METHOD FOR ITS MANUFACTURING THE SAME

(75) Inventor: Wataru Horiuchi, Tokyo (JP)

(73) Assignee: Polymatech Co., Ltd. (JP)

( * ) Notice: Under 35 U.S.C. 154(b), the term of this patent shall be extended for 0 days.

(21) Appl. No.: 09/253,404

(22) Filed: Feb. 19, 1999

(30) Foreign Application Priority Data

Feb. 20, 1998 (JP) ..... 10-054244

(51) Int. Cl.[7] ..... H01H 1/02; H01H 1/10
(52) U.S. Cl. ..... 200/262; 200/512; 200/267
(58) Field of Search ..... 200/5 A, 512–517, 200/85 R, 262–270, 85 A, 61.44, 11 TW, 302.2; 252/511; 307/119; 178/18.05

(56) References Cited

U.S. PATENT DOCUMENTS 3,777,082 * 12/1973 Hatley et al. ..... 200/5 A
4,163,879 * 8/1979 Mayer et al. ..... 200/11 TW
4,207,444 * 6/1980 Kley ..... 200/5 A
4,302,648 * 11/1981 Sado et al. ..... 200/512
4,499,342 * 2/1985 Nakayama ..... 200/5 A
4,634,818 * 1/1987 Hayespankhurst et al. ..... 200/5 A
4,652,704 * 3/1987 Franklin ..... 200/5 A
4,659,873 * 4/1987 Gibson et al. ..... 178/18
4,745,301 * 5/1988 Michalchik ..... 307/119
4,768,230 * 8/1988 Viebrantz et al. ..... 200/302.2 X
4,805,723 * 2/1989 Aoki et al. ..... 200/85 A X
4,874,549 * 10/1989 Michalchik ..... 252/511
5,780,793 * 7/1998 Buchholz et al. ..... 200/61.44

FOREIGN PATENT DOCUMENTS 6-93335 11/1994 (JP) .
8-276435 10/1996 (JP) .

* cited by examiner

*Primary Examiner*—J. R. Scott
(74) *Attorney, Agent, or Firm*—McGlew and Tuttle, P.C.

(57) ABSTRACT

A contact key switch according to the present invention is a highly reliable contact key switch allowing the prevention of rise of a resistance, easy integral molding, no need of selection of an adhesive and adhesion process for use accomplished by forming the surface of the electroconductive contact portion with a fabric or a nonwoven fabric made of a electroconductive fiber like a carbon fiber, and by using same material the rubber-like elastic body of the main body of the contact switch.

12 Claims, 4 Drawing Sheets

CONTACT KEY SWITCH AND METHOD FOR ITS MANUFACTURING THE SAME

DETAILED DESCRIPTION OF THE INVENTION

1. Technical Field of the Invention

The present invention relates to a contact key switch used as an input key for an electronic instruments such as a telephone, a calculator, and an AV instrument, or a automobile such as a power window and a remote control led door mirror, and a method for its manufacture.

2. Related Art

As a rule, the rubber-like elastic key pad of the main body of a contact key switch is manufactured using as a material an insulating rubber-like elastic body represented by materials such as a natural rubber, synthetic rubber, or thermoplastic elastic body, by processing with various methods such as compression molding, injection molding, etc. Among the rubber-like elastic body, silicon rubber is frequently used for having many characteristics, such as electric insulation, low temperature resistant, heat-proof, chemical resistance, precision molding ability, and resilience elasticity, necessary for a contact key switch.

A contact portion is exemplified by those molded integrally with an electroconductive chip on the contact portion of the key pad in a given shape by mixing carbon black and metal powder in a rubber-like elastic material, those formed by preparing a layer of electroconductive ink on the contact portion by screen printing or pad printing after previous making the main body of the contact key switch, and those molded integrally after preparing the electroconductive chip by punching a layering body, that is made by layering a metal layer plated a metal plate on a rubber layer, in a given shape.

SUMMARY OF THE INVENTION

However, said contact portion has been made by mixing carbon black and metal powder, which are electroconductive media, in an elastic material or ink. Therefore, compounding a large quantity of an electroconductive medium yields some 10 ohms or higher of a contact resistance, not allowing a use suitable for the low contact resistance of some ohms or lower.

In addition, the contact portion of a contact switch made by plating of a metal on a rubber layer is, as described in Japanese Patent Publication 06(1994)-93335 and Japanese Patent Laid-Open 08(1996)-276435, is made of a metal, and suitable for the use for a low resistance. However, silicon as the material of the keypad is normally difficult to adhere to a metal as known from the use as a release agent. Therefore, adhesive and adhering procedure should be used by selection to make adhesion of both materials possible. On the other hand, both sides of the electroconductive chip have consisted of a metal layer and an insulating rubber layer. Therefore, the metal layer should be contact with the mold surface at insertion of the mold in molding step. This step makes the efficiency of manufacture worse and cost higher.

To solve the aforementioned problem, the present invention provides a contact key switch usable for a low resistance by making the surface of contact portion of contact switch with electroconductive woven fabric or electroconductive nonwoven.

The material of the rubber part of the main body of the contact switch and layered body is, as used as the contact switch, not specially restricted if having a high resilience elasticity, however, preferably an insulating rubber-like elastic body represented by a synthetic rubber selected from at least any one of natural rubber, ethylenepropylene rubber, silicon rubber, butadiene rubber or a thermoplastic elastic body selected from at least any one of styrene, esters, olefins, urethanes, and vinylated compounds.

On the other hand, the constituent of the electroconductive woven fabric or electroconductive nonwoven fabric is not specially restricted if at least one of warp fibers or woof fibers is consisted of electroconductive fibers.

Further, the present invention provides a contact key switch excellent in characteristics such as low temperature resistant, heat-proof, c chemical resistance, precision molding ability, and resilience elasticity, by using silicon rubber for a rubber-like elastic body.

Furthermore, the present invention provides a contact key switch usable for a low resistance by using material selected from carbon fiber and metal fiber for an electroconductive woven fabric or an electroconductive nonwoven fabric.

According to the present invention, carbon fibers composing the electroconductive woven fabric or the electroconductive nonwoven fabric is selected from fiber constitution of number of wales of 10 to 30 per 25 mm and filament number of 1000 to 6000 in the electroconductive woven fabric and carbon mass rate of 0.03 to 2.5 g per $cm^3$ in the electroconductive nonwoven fabric. A smaller number of fiber constitution than that of respective number ranges increases surface resistance by invasion of unvulcanized rubber, in the surface of layered contact portion due to large opening portion of the electroconductive woven fabric or the electroconductive nonwoven fabric. A larger number of fiber constitution than that of respective number ranges easily allows surface dissociation by lowered holding performance of vulcanized rubber and fibers caused by no invasion of unvulcanized rubber between fibers due to small opening portion of the electroconductive woven fabric or the electroconductive nonwoven fabric.

The method for manufacture of carbon fibers is not specially restricted, and can be selected from fibers prepared by carbonizing through heat treatment of fibers made by spinning of an organic fibers such as rayon and polyacrylonitrile and purified petroleum pitch in an inert gas atmosphere.

The material of metal fiber is not specially restricted, and may be fibers such as gold, gold alloy, silver, copper, copper alloy, iron, nickel, brass, and when corrosible material is used, those of which the entire surfaces has been plated with a material, such as gold or gold alloy, not easily corrosible.

The layered contact portion is manufactured by penetrating unvulcanized rubber into the opening portion of the electroconductive woven fabric or the electroconductive nonwoven fabric to harden and make a layered body, and by punching the layered body in a given shape.

The layered body made of the rubber layer and the electroconductive woven fabric or the electroconductive nonwoven fabric, of the present invention, is manufactured by layering the electroconductive woven fabric or the electroconductive nonwoven fabric on the unvulcanized rubber to subject to compression molding.

The layered body made of the rubber layer and the electroconductive woven fabric or the electroconductive nonwoven fabric, of the present invention, is manufactured by layering evenly the unvulcanized rubber on the electroconductive woven fabric or the electroconductive nonwoven fabric using a roll or a blade, if necessary, by further layering the electroconductive woven fabric or the electroconductive nonwoven fabric on the unvulcanized rubber, and by using a hardening furnace with far infrared rays, near-infrared rays, or heat air.

According to aforementioned method, the unvulcanized rubber is hardened after penetrating into the opening portion of the electroconductive woven fabric or the electroconductive nonwoven fabric to allow easy formation of the layered contact portion. Thus, selection and use of an adhesive and adhesion process is not necessary.

The condition of the unvulcanized rubber of the present invention is not restricted to either a liquid form or a solid form. However, when the unvulcanized rubber is evenly layered on the electroconductive woven fabric or the electroconductive nonwoven fabric by using a roll or a blade, the liquid form is preferable for easy penetration into the opening portion of the electroconductive woven fabric or the electroconductive nonwoven fabric.

In the use of silicon rubber for the rubber layer, if silane coupling agent is applied to the electroconductive woven fabric or the electroconductive nonwoven fabric, if necessary, the holding performance of the electroconductive woven fabric or the electroconductive nonwoven fabric is increased. A silane coupling agent is used broadly in order to improve reactivity with the material which is hard to stick to an end usually. For example, there are vinyltrimetoxylane, amino-silane, and these are appropriately selected according to the material. In addition, the rubber layer is not restricted to insulating or electroconductive rubber layer. However, if electroconductive rubber is used, the contact resistance of the contact portion shows a tendency to fall to a lower value. The layered contact portion is formed by punching the layered body in a given shape. The layered contact portion is engaged to the contact part of the mold of the rubber-like elastic key pad to fit the surface of the electroconductive woven fabric or the electroconductive nonwoven fabric to the mold, followed by integrated molding by inserting the rubber-like elastic material in the mold.

The layered body made of the rubber layer and the electroconductive woven fabric or the electroconductive nonwoven fabric, of the present invention, is manufactured by putting the electroconductive woven fabric or the electroconductive nonwoven fabric on the mold for injection molding, extruding the thermoplastic elastic body to the mold, and seizing the melted thermoplastic elastic body to the electroconductive woven fabric or the electroconductive nonwoven fabric or penetrating to the opening portion of the electroconductive woven fabric or the electroconductive nonwoven fabric.

Layering the electroconductive woven fabric or the electroconductive nonwoven fabric on both sides of the rubber layer causes both sides to have electroconductivity in the layered contact portion. Therefore, a jig or an apparatus for identifying the side of the layered contact portion is not necessary for insertion of the layered contact portion in the contact part of the mold to allow efficient manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
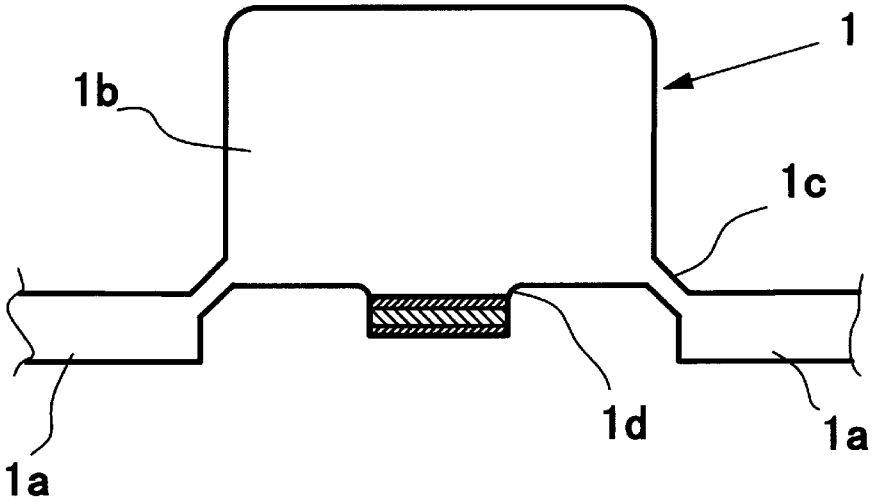
FIG. 1 is a sectional view of a contact key switch.

Embodiments of the present invention are given below according to the FIG. 1. FIG. 1 is a sectional view of a contact key switch, showing an embodiment of the present invention.

In the FIG. 1, main body 1 of the contact key switch has been made of non-operation portion 1*a*, operation portion 1*b*, thin skirt portion 1*c* connecting them, and a projecting portion 1*d* projecting downward integrally with an elastic body. The surface of layered contact portion 2 is made of the electroconductive woven fabric or the electroconductive nonwoven fabric.

In one embodiment, silicon rubber was used for the main body 1 of the contact key switch. For a carbon fiber forming the electroconductive woven fabric or the electroconductive nonwoven fabric of the surface of the contact portion, Torekakurosu made by Toray K. K. was used in the electroconductive woven fabric and Torekamatto (made by Toray K. K.) was used in the electroconductive nonwoven fabric. Electroconductive silicon rubber was used in the rubber layer.

The rubber layer of layered electroconductive portion is not specially restricted if integrated hardening is possible by vulcanizing the main body of the contact switch and carbon fiber fabric. However, a rubber-like elastic body made of the same material as that of the main body of the contact switch is preferable. Silicon rubber containing 50 weight part of carbon black was used. The contact resistance of the layered contact portion was 2 to 3 Ω.

A method for manufacture of the layered contact portion of the present invention is described below for using the carbon fiber fabric according to the FIG. 2.

Figure 2:
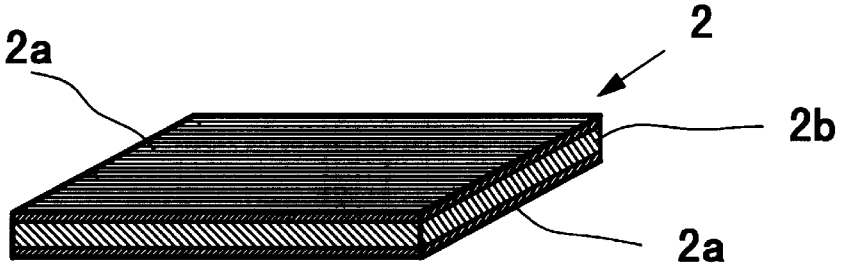
FIG. 2 is a perspective side view of the layered body made of a rubber and fiber fabric.
Figure 3:
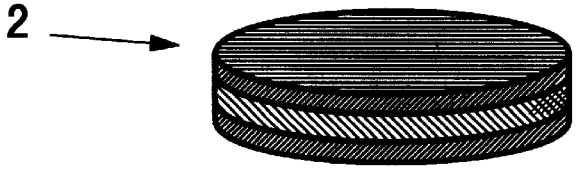
FIG. 3 is a perspective side view of the layered contact portion.

As shown in the FIG. 2, the layered body 2 made by layering a rubber sheet 2*b* on the carbon fiber fabric 2*a* and layering the carbon fiber fabric 2*a* on the rubber sheet 2*b* was subjected to compression molding under 190 kgf/cm$^2$ using unvulcanized electroconductive silicon rubber layer and the carbon fiber fabric (Torekakurosu made by Toray K. K.), vulcanized and integrated, punched in a given shape to manufacture the layered contact portion as shown in the FIG. 3. In the case of using the Torekamatto (made by Toray K. K.) as the carbon fiber nonwoven fabric for the layered contact portion, manufacture was carried out by same method as that of the carbon fiber fabric.

The contact key switch was manufactured by putting the layered contact portion in a mold and putting silicon rubber as a rubber-like elastic body of the main body 1 of the contact switch in the mold to mold integrally. The compression pressure at the compression molding is not restricted if the layered contact portion can be molded in a given thickness. However, Preferable pressure is 100 to 200 kgf/cm$^2$ in either unvulcanized rubber of liquid form or solid form.

Table 1 presents the result of the electroconductive woven fabric in the layered contact portion made of carbon fibers.

Similarly, Table 2 presents the result of the electroconductive nonwoven fabric.

As the result of evaluation of resistance (contact resistance), holding performance, molding performance, and processibility for release, the embodiments (e) and (k) were good in all the items. Other embodiments are presented as comparative embodiments in respective tables. The contact resistance is represented by ⊙ for resistance less than 2 Ω, ○ for 2 to 10 Ω, and X for more than 10 Ω.

Holding performances are represented by ○ for a case of no problem in close contact of a rubber with fibers and X a case possible to fall down. The molding performances are represented by ○ for a case in which the shape of fibers have been kept after molding and X a case in which the shape of fibers have not been kept by moving of fibers after molding. The processibility was represented by ○ for a case in which a section is clearly punched by punching in a given shape after molding and X a case in which many burr have occurred by falling down of fibers pulled out by a blade.

TABLE 1

| | number of wale X (25 mm) | number of filament y | resistance | holding performance | molding performance | processibility |
|---|---|---|---|---|---|---|
| a | X < 10 | y < 1000 | x | ○ | x | ○ |
| b | " | 1000 ≦ y ≦ 6000 | x | ○ | x | ○ |
| c | " | 6000 < y | x | ○ | ○ | x |
| d | 10 ≦ X ≦ 30 | y < 1000 | ○ | ○ | x | ○ |
| e | " | 1000 ≦ y ≦ 6000 | ⊙ | ○ | ○ | ○ |
| f | " | 6000 < y | ⊙ | x | ○ | x |
| g | 30 < X | y < 1000 | ○ | x | ○ | ○ |
| h | " | 1000 ≦ y ≦ 6000 | ⊙ | x | ○ | ○ |
| i | " | 6000 < y | ⊙ | x | ○ | x |

TABLE 2

Electroconductive woven fabric

| | carbon mass rate z (g/m$^2$) | resistance | holding performance | molding performance | processibility |
|---|---|---|---|---|---|
| j | z < 30 | x | ○ | x | x |
| k | 30 ≦ z ≦ 1000 | ○ | ○ | ○ | ○ |
| l | 1000 < z | ○ | x | ○ | ○ |

The contact key switch of the present invention has the surface of electroconductive contact portion made of woven fabric or nonwoven fabric of electroconductive fibers. Thus, the same low resistance was yielded as that of the contact portion made of a metal plate.

Further, manufacture of the layered contact portion by punching in a given shape the layered body, of which both surfaces of the rubber layer is covered by the electroconductive woven fabric or the electroconductive nonwoven fabric, gives electroconductivity to the both surfaces of the layered contact portion. Therefore, a jig or an apparatus or the like for identifying the side of the layered contact portion is not necessary for insertion of the layered contact portion in the contact part of the mold to allow efficient manufacture and a low cost.

The main body of the contact key switch and the electroconductive woven fabric or the electroconductive nonwoven fabric are easily and integrally molded by using same material to the rubber layer of the layered contact portion and the rubber-like elastic body of the main body of the contact switch. Thus, selection of an adhesive and adhesion process for use is not necessary.

Furthermore, the use of carbon fibers for the electroconductive woven fabric or the electroconductive nonwoven fabric prevents an increasing of resistance caused by oxidation which easily occurs in a metal to provide the contact key switch of high reliability.

The carbon fibers are selected from a composition of number of wales of 10 to 30 per 25 mm and filament number of 1000 to 6000 in the electroconductive woven fabric and from carbon mass rate of 0.03 to 2.5 g/cm$^3$ in the electroconductive nonwoven fabric. By this, a high quality contact key switch has a low contact resistance and a high durability.

Figure 4A:
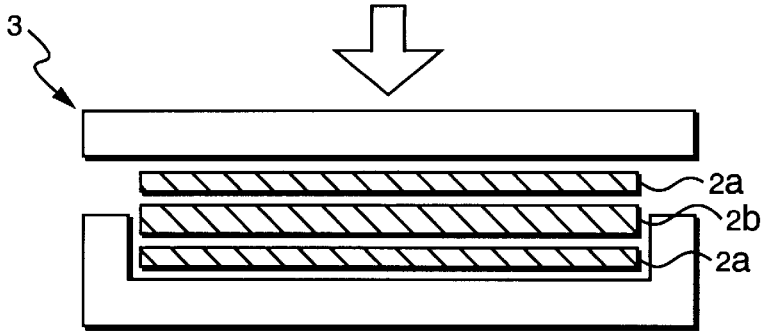
FIG. 4 is a view of a first set of method steps of the present invention.
Figure 4B:
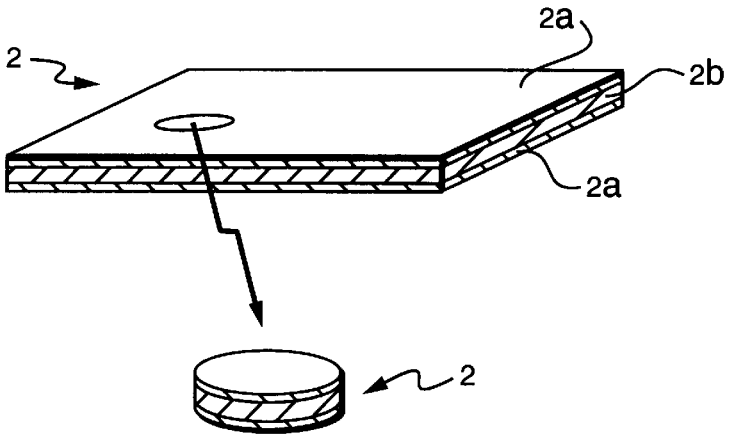
Figure 4C:
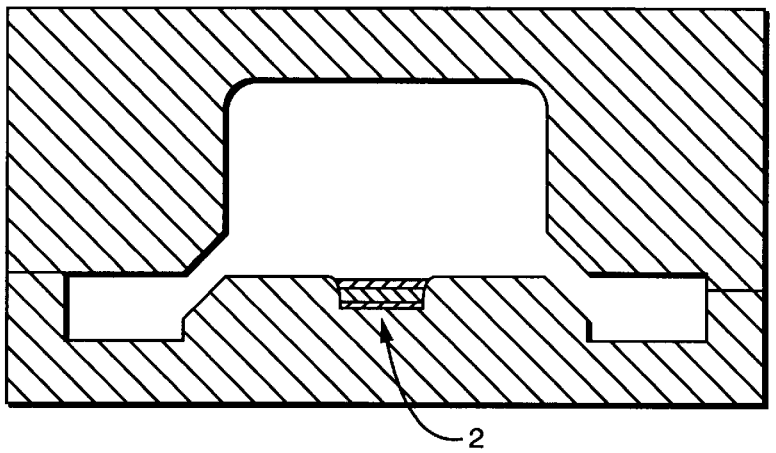

FIG. 4 shows the steps of penetrating an unvulcanized rubber into the open portion of an electro-conductive woven fabric or an electro-conductive non-woven fabric and is hardened to form layered body. The penetration of an unvulcanized rubber in the opening portion of the electro-conductive woven fabric or the electro-conductive non-woven fabric is carried out in compression molding 3. The layered body 2 is punched in a given shape to make a layered contact portion and to form a part of a key pad made of a rubber-like elastic body so as to make the electro-conductive woven fabric or the electro-conductive non-woven fabric as a surface.

Figure 5A:
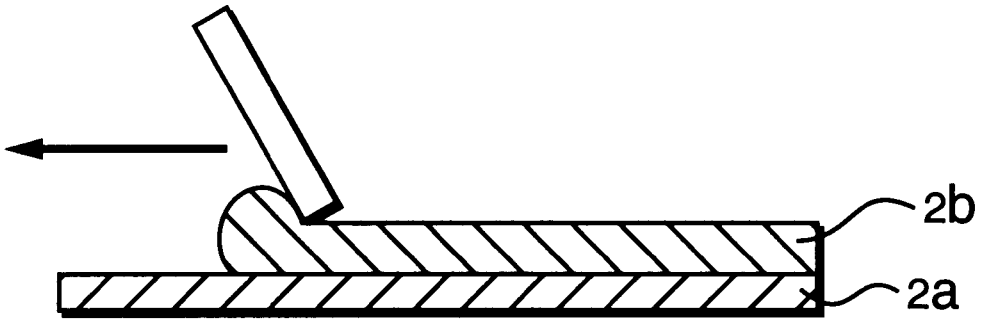
FIG. 5 is a view of a second set of method steps of the present invention.
Figure 5B:
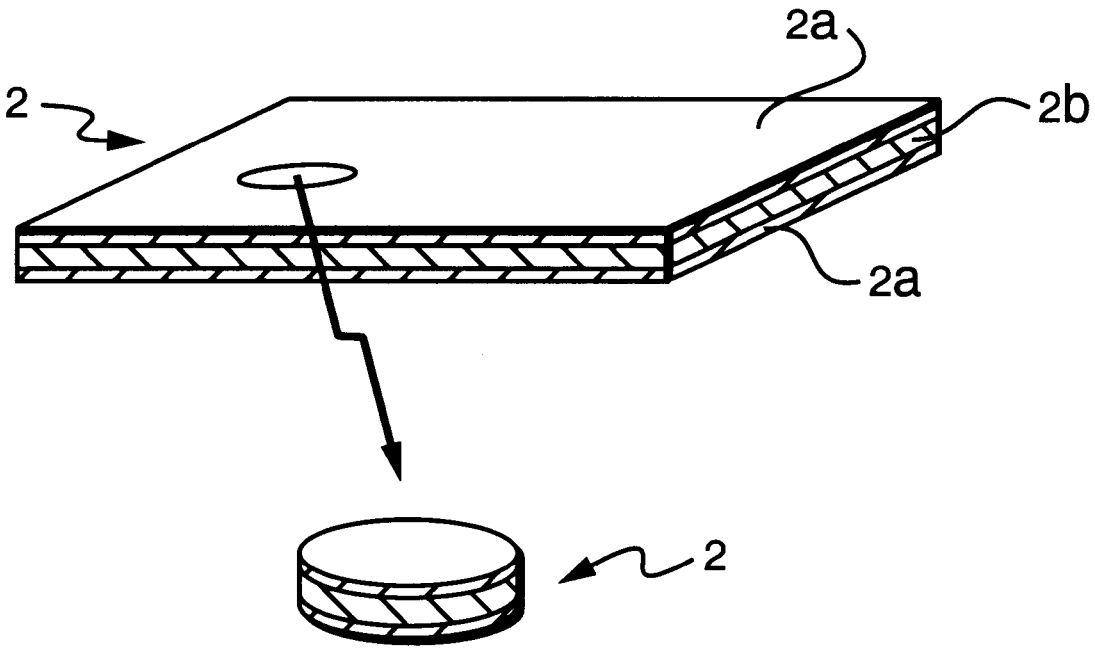

FIG. 5 shows a second set of method steps for manufacture of the contact portion. Unvulcanized rubber penetrates in the opening portion of the electro-conductive woven fabric or the electro-conductive non-woven fabric to apply or print by using a roll or a blade, or the like and is hardened in a hardening furnace to make the layered body 2.

Figure 6A:
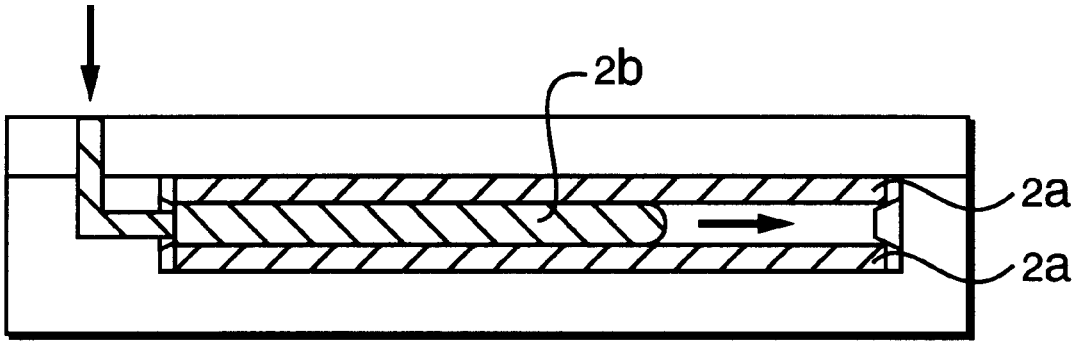
FIG. 6 is a view of a third set of method steps of the present invention.
Figure 6B:
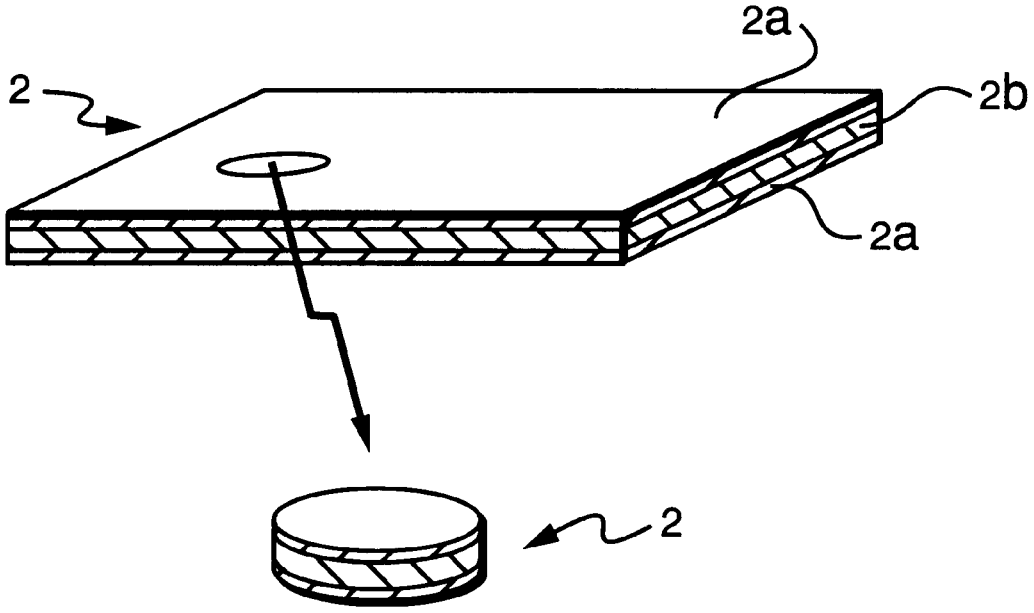

FIG. 6 shows a third set of method steps for manufacture of the contact portion. The electro-conductive woven fabric or the electro-conductive non-woven fabric is put in a mold for injection molding. A thermoplastic elastomer is injected into the mold, and a melted thermoplastic elastic body is deposited on the electro-conductive woven fabric or the electro-conductive non-woven fabric or penetrated in an open portion thereof to make a layered body. The layered body is punched in a given shape to make a layered contact portion and a part of a key pad made of a rubber-like elastic body is formed to make the electro-conductive woven fabric or the electro-conductive non-woven fabric as a surface.

While specific embodiments of the invention have been shown and described in detail to illustrate the application of the principles of the invention, it will be understood that the invention may be embodied otherwise without departing from such principles.

What is claimed is:

1. A contact key switch comprising:

a main body;

a contact portion on said main body, a surface of said contact portion being formed of a plurality of conductive layers, said contact portion includes first and second said conductive layers connected to opposite sides of an elastic layer, said elastic layer being conductive.

2. The contact key switch in accordance with claim 1, wherein:

one of said plurality of conductive layers is an electroconductive woven fabric.

3. The contact key switch in accordance with claim 1, wherein:

said surface of said contact portion is made of an electroconductive woven or non-woven fabric in the contact key switch of which a part of a keypad composed of a rubber-like elastic body has the contact portion that is a layered body of an electro-conductive woven and a non-woven fabric.

4. The contact key switch in accordance with claim 3, wherein:

said electro-conductive woven fabric or said electro-conductive non-woven fabric includes metal fibers.

5. The contact key switch according to claim 4, wherein:

said rubber-like elastic body is made of silicon rubber.

6. The contact key switch in accordance with claim 1, wherein:

said contact portion is a layered body of an electro-conductive woven fabric and a rubber-like elastic body, and wherein said electro-conductive woven fabric is made of carbon fiber including 10 to 30 wales per 25 mm and having a filament number of 1000 to 6000.

7. The contact key switch in accordance with claim 1, wherein:

said contact portion is a layered body of an electro-conductive non-woven fabric and a rubber-like elastic body, and wherein said electro-conductive non-woven fabric is made of a carbon fiber having a carbon mass rate from 0.03 to 2.5 g/cm3.

8. A contact key switch comprising:

a main body;

a contact portion on said main body, a surface of said contact portion being formed of a plurality of conductive layers, said contact portion being a layered body of an electro-conductive woven fabric and a rubber-like elastic body, and wherein said electro-conductive woven fabric is made of carbon fiber including 10 to 30 wales per 25 mm and having a filament number of 1000 to 6000.

9. The contact key switch according to claim 8, wherein:

said rubber-like elastic body is made of silicon rubber.

10. A contact key switch comprising:

a main body;

a contact portion on said main body, a surface of said contact portion being formed of a plurality of conductive layers, said contact portion being a layered body of an electro-conductive non-woven fabric and a rubber-like elastic body, and wherein said electro-conductive non-woven fabric is made of a carbon fiber having a carbon mass rate from 0.03 to 2.5 g/cm3.

11. The contact key switch according to claim 10, wherein:

said rubber-like elastic body is made of silicon rubber.

12. A contact key switch comprising:

a main body;

a contact portion on said main body, a surface of said contact portion being formed of a plurality of conductive layers, said surface of said contact portion being made of an electro-conductive woven or non-woven fabric in the contact key switch of which a part of a keypad composed of a rubberlike elastic body has the contact portion that is a layered body of an electro-conductive woven and a non-woven fabric, said electro-conductive woven fabric or said electro-conductive non-woven fabric includes metal fibers, and said rubber-like elastic body is made of silicon rubber.

* * * * *